US006288484B1

(12) United States Patent
Setsuda et al.

(10) Patent No.: US 6,288,484 B1
(45) Date of Patent: Sep. 11, 2001

(54) ELECTRICAL INSULATOR AND CATHODE-RAY TUBE PROVIDED WITH THE SAME

(75) Inventors: Takashi Setsuda, Aichi; Hirokazu Kanno, Mie, both of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/344,381

(22) Filed: Jun. 25, 1999

(30) Foreign Application Priority Data

Jun. 29, 1998 (JP) ..... P10-182239

(51) Int. Cl.[7] ..... H01J 31/00

(52) U.S. Cl. ..... 313/477 HC; 445/43; 445/72

(58) Field of Search ..... 313/445, 477 HC, 313/318.05, 318.06, 51; 439/602, 618; 174/50, 57, 52, 1, 145, 176, 137 B

(56) References Cited

U.S. PATENT DOCUMENTS 3,867,670 * 2/1975 Schor et al. ..... 313/318
5,990,610 * 11/1999 Matsumoto et al. ..... 313/477 HC

FOREIGN PATENT DOCUMENTS 2 537 339 6/1998 (FR) ..... H01J/29/92
7-94100 4/1995 (JP) .
8-111191 4/1996 (JP) .

* cited by examiner

*Primary Examiner*—Vip Patel
*Assistant Examiner*—Ken A Berck
(74) *Attorney, Agent, or Firm*—Ronald P. Kananen; Rader, Fishman & Grauer

(57) ABSTRACT

An electrical insulator, provided between a stem of a cathode-ray tube and a stem base mounted to the stem is arranged, for insulating stem pins erected on the stem from each other, thereby improving the dielectric strength between the stem pins and a cathode-ray tube on which the electric insulator is mounted. The electrical insulator includes a fixed portion held between the stem and the stem base, and a projecting portion to be caught in a tip-containing portion of the stem base, the projecting portion being formed integrally with the fixed portion, wherein the fixed portion is provided with pin containing portions for containing the stem pins to be insulated by forming notches in the fixed portion on the outer edge side.

13 Claims, 4 Drawing Sheets

ELECTRICAL INSULATOR AND CATHODE-RAY TUBE PROVIDED WITH THE SAME

BACKGROUND OF THE INVENTION

The present invention relates to improvement in electrical insulation of electrodes called stem pins, provided for supplying/receiving electric signals, of a cathode-ray tube.

With the tendency to increase a voltage applied to stem pins of an electron gun for improving the performance of a color cathode-ray tube, a stem portion of the cathode-ray tube has been insulated by coating the stem portion with a room temperature curing type silicon resin. The room temperature curing type silicon resin, however, is disadvantageous in that it entraps bubbles when being cured. To solve degradation of insulation due to the bubbles, an electrical insulator used for insulation of a stem portion of a cathode-ray tube, and a cathode-ray tube provided with the electrical insulator for improving the insulation of a stem portion have been disclosed in Japanese Patent Laid-open Nos. Hei 7-94100 and Hei 8-111191.

According to the invention disclosed in Japanese Patent Laid-open No. Hei 7-94100, a cathode-ray tube with the improved insulation is manufactured by a manner of preparing a flat electrical insulator made from a silicon compound, punching the electrical insulator with a forming die to form holes in which stem pins and a stem tip are to be inserted, sticking the electrical insulator on a stem base, mounting the stem base thus stuck with the electrical insulator on a stem of the cathode-ray tube, and heating the cathode-ray tube to ensure the adhesive strength of the electrical insulator to the stem base.

According to the invention disclosed in Japanese Patent Laid-open No. Hei 8-111191, a cathode-ray tube is manufactured by a manner of extruding a thermosetting adhesive type silicon rubber composition into a tape, punching the tape into a half-cut shape using a die set to form holes in which stem pins required to be insulated when high voltages are applied thereto and a stem tip are to be inserted, sticking the electrical insulator tape on a stem base in such a manner as to be caught between a tip containing portion of the stem base and the stem tip, and mounting the stem base thus stuck with the electrical insulator tape on a stem of the cathode-ray tube, thereby improving the insulation between the stem pins to which high voltages are applied.

In the inventions disclosed in Japanese Patent Laid-open Nos. Hei 7-94100 and Hei 8-111191, the electrical insulator formed into the flat or tape shape is punched using a forming die or die set, and accordingly a surface to be brought into contact with the stem of the electrical insulator is formed into a smooth plane.

As a result, in both the inventions, when the stem base stuck with the electrical insulator is mounted on the stem, air may be entrapped between the smooth surface of the electrical insulator and the surface of the stem, and if gaps formed by the entrapped air are present between the stem pins required to be insulated, there may occur a problem in generating discharge due to degradation of insulation of the stem portion of the cathode-ray tube.

SUMMARY OF THE INVENTION

The present invention has been made to solve the above problem, and a first object of the present invention is to provide an electrical insulator capable of preventing entrapment of air between the surface of the electrical insulator stuck on a stem base and the surface of a stem.

A second object of the present invention is to provide a cathode-ray tube in which the above electrical insulator is mounted between a stem and a stem base of the cathode-ray tube, thereby improving the insulation between stem pins.

To achieve the first object, according to a first aspect of the present invention, there is provided an electrical insulator, which is provided between a stem of w a cathode-ray tube of an electron gun and a stem base mounted to the stem, for insulating stem pins erected on the stem from each other, the electrical insulator including: a fixed portion held between the stem and the stem base; and a projecting portion to be caught in a tip-containing portion of the stem base, the projecting portion being formed integrally with the fixed portion; wherein the fixed portion is provided with pin-containing portions for containing the stem pins to be insulated by forming notches in the fixed portion on the outer edge side.

An upper surface of the fixed portion is preferably formed into such a shape as to be brought substantially into line-contact with the stem when the stem base stuck with the electrical insulator is mounted to the stem.

Each of the pin containing portions opened outwardly, which are formed in the fixed portion, is preferably shaped such that a gap on the outer edge side is larger than that on the innermost side.

With this configuration, at the initial stage of contact of the fixed portion of the electrical insulator with the surface of the stem, the fixed portion is brought substantially into line-contact with the surface of the stem, so that it is possible to prevent entrapment between the fixed portion and the surface of the stem. Also, as the stem base is gradually pressed on the stem, the contact surface of the fixed portion with the glass surface of the stem is gradually enlarged, and in this case, since air pushed out by the enlarged contact surface is directed toward the outer edge side of the fixed portion on which the notches as the pin-containing portion are formed, it is possible to certainly prevent entrapment of air between the fixed portion and the surface of the stem. Further, since the pin containing portion is shaped such that the gap on the outer edge side is larger than that on the innermost side, air on the innermost side is liable to be discharged to the outer edge side, with a result that it is possible to more certainly prevent entrapment between the fixed portion and the surface of the stem.

To achieve the second object, according to a second aspect of the present invention, there is provided a cathode-ray tube including: an electrical insulator mounted between a stem and a stem base of an electron gun, the electrical insulator including a fixed portion and a projecting portion formed integrally with the fixed portion; wherein the fixed portion is held between the stem and the stem base in such a manner that stem pins erected on the stem are contained in pin containing portions formed in the fixed portion; and the projecting portion is caught between a tip of the stem and a tip containing portion of the stem base.

With this configuration, it is possible to ensure insulation between the stem pins required to be insulated by the fixed portion, and to ensure the adhesiveness between the stem tip and the tip-containing portion of the stem base by the projecting portion.

BRIEF DESCRIPTION OF THE DRAWINGS

FIGS. 2A to 2C are structural views of a first embodiment of the electrical insulator of the present invention, wherein FIG. 2A is a plan view, FIG. 2B is a sectional view taken on line X—X of FIG. 2A, and FIG. 2C is a sectional view taken on line Y—Y of FIG. 2A;

FIGS. 3A to 3C are structural views showing a state in which the first embodiment of the electrical insulator is mounted to a stem base, wherein FIG. 3A is a front view, FIG. 3B is a sectional view taken on line X-O-X of FIG. 3A, and FIG. 3C is a sectional view taken on line X-O-Y;

FIGS. 4A to 4C are structural views of a second embodiment of the electrical insulator of the present invention, wherein FIG. 4A is a plan view, FIG. 4B is a sectional view taken on line X—X of FIG. 4A, and FIG. 4C is a sectional view taken on line Y—Y of FIG. 4A; and FIGS. 5A and 5B are structural views showing a state in which the second embodiment of the electrical insulator is mounted on a stem base, wherein FIG. 5A is a front view and FIG. 5B is a sectional view taken on line X-O-Z.

DETAILED DESCRIPTION OF THE PREFERRED EMBODIMENTS

Hereinafter, preferred embodiments of the present invention will be described in detail with reference to the accompanying drawings.

Figure 1:
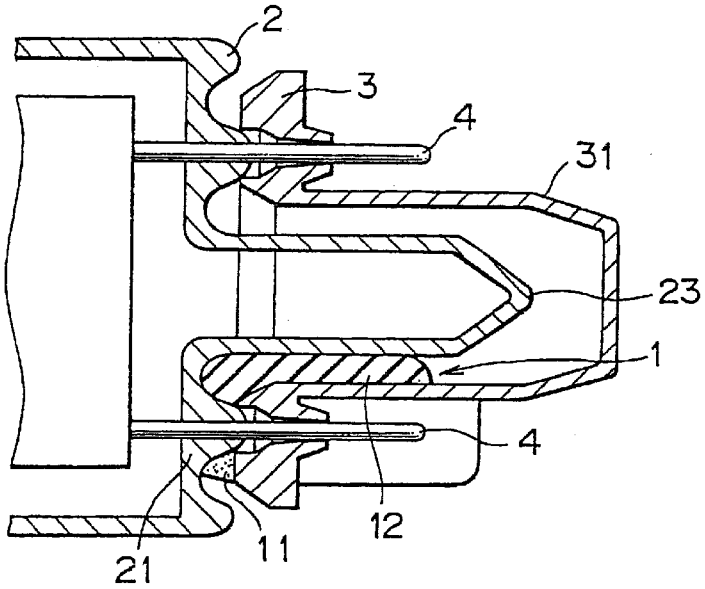
FIG. 1 is a sectional view showing a state in which an electrical insulator of the present invention is mounted between a stem and a stem base of a cathode-ray tube.

FIG. 1 is a sectional view showing a state in which an electrical insulator of the present invention is mounted between a stem and a stem base of a cathode-ray tube.

In FIG. 1, reference numeral 1 designates an electrical insulator. As is fully shown in FIGS. 2A to 2C, the electrical insulator 1 includes a fixed portion 11 and a projecting portion 12 integrated with the fixed portion 11. The fixed portion 11 is held between a stem 2 and a stem base 3, and mounted in a state being crushed by pressing the stem base 3 to the stem 2. The fixed portion 11 is arranged in a state in which branch portions thereof project between outer fillets 21 formed around the roots of stem pins 4 required to be insulated when high voltages are applied thereto, whereby the stem pins 4 are electrically insulated from each other by the fixed portion 11. The projecting portion 12 is caught in a tip-containing portion 31 of the stem base 3 for adhesively bonding a tip 23 of the stem 2 to the tip-containing portion 31.

Figure 2A:
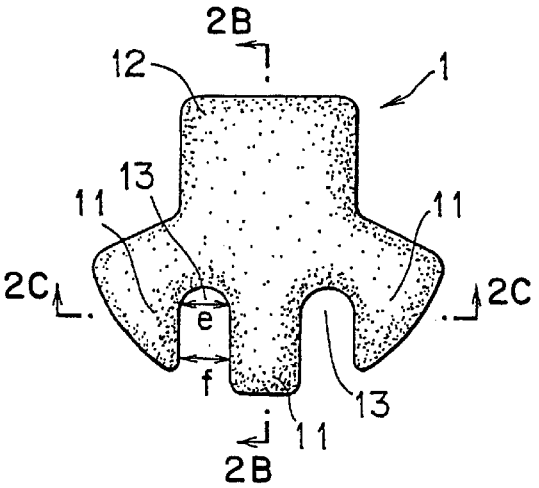
Figure 2B:
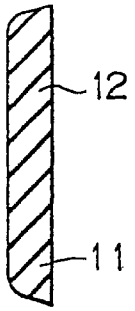
Figure 2C:
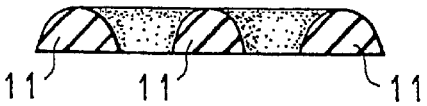

FIGS. 2A to 2C show a structure of a first embodiment of the electrical insulator 1 of the present invention, wherein FIG. 2A is a plan view, FIG. 2B is a sectional view taken on line X—X of FIG. 2A, and FIG. 2C is a sectional view taken on line Y—Y of FIG. 2A.

In FIG. 2A, the electrical insulator 1 is a plastic material obtained from a self-adhesive type silicon rubber by transfer molding. The electrical insulator 1 includes the fixed portion 11 and the projecting portion 12 integrated with the fixed portion 11. The fixed portion 11 is held between the stem 2 and the stem base 3 for electrically insulating the stem pins 4 necessary for insulation from each other. When the stem base 3 is mounted to the stem 2, the projecting portion 12 is caught in the tip-containing portion 31 of the stem base 3 for adhesively bonding the tip 23 of the stem 2 to the tip-containing portion 31.

As shown by the cross-section of FIG. 2C, the stem base 3 side or the bottom side in FIG. 2C of the fixed portion 11 is formed into a flat plane to be easily brought into close-contact with the stem base 3, and the stem 2 side or the top side in FIG. 2C of the fixed portion 11 is formed into, for example, an arcuate shape or an approximately triangular shape (not shown) in cross-section to be brought substantially into line-contact with the surface of the stem 2 at the initial stage of contact of the fixed portion 11 with the surface of the stem 2. The fixed portion 11 has pin-containing portions 13 provided by forming notches in the fixed portion 11 on the outer edge side. In the pin-containing portion 13, a gap "f" on the outer edge side is set to be larger than a gap "e" on the innermost side. On the other hand, as shown in FIG. 2B, each of the top and bottom surfaces of the projecting portion 12 is formed into a flat plane.

The electrical insulator 1 has a specific thickness ranging from 1 mm to 3 mm. When being held and pressed between the stem 2 and the stem base 3 of the cathode-ray tube, the electrical insulator 1 having the above thin thickness is crushed to cover the outer peripheries of the stem pins 4 for supplying high voltages.

Figure 3A:
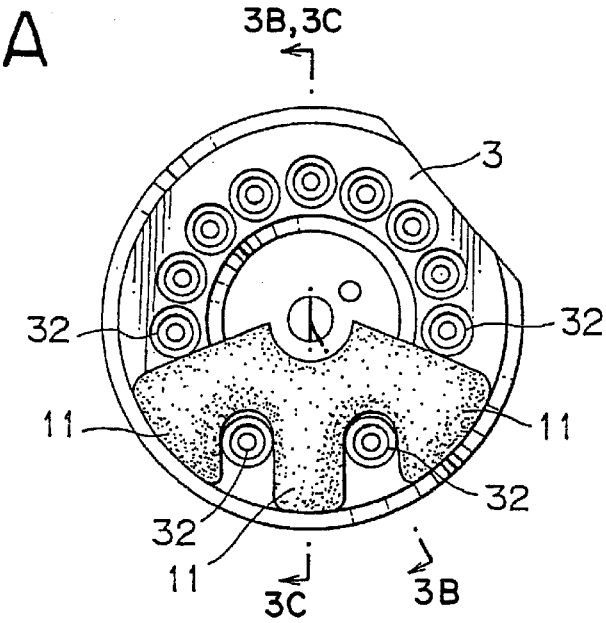
Figure 3B:
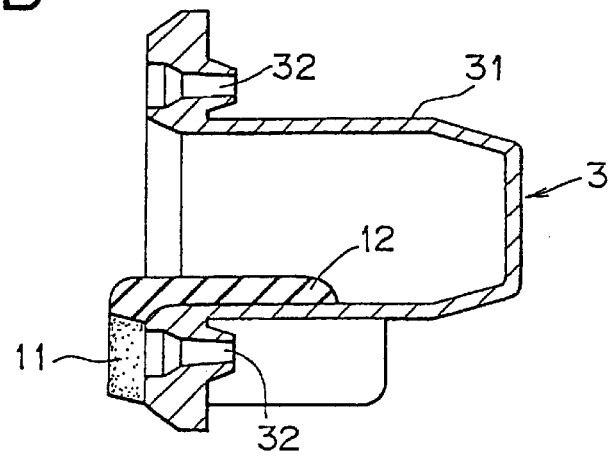
Figure 3C:
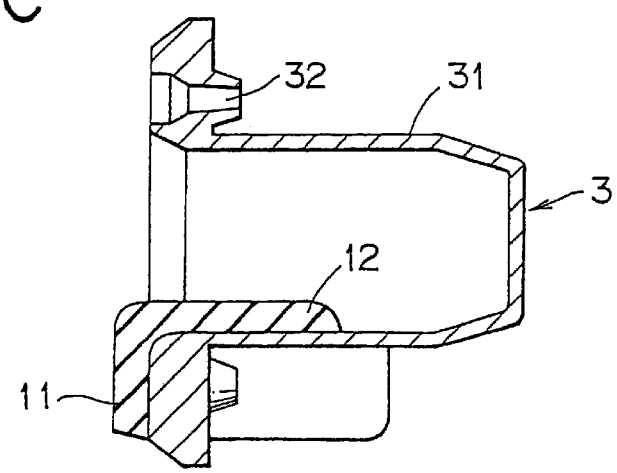

A method of manufacturing a cathode-ray tube using the electrical insulator 1 previously mounted on the stem base 3 will be described below. FIGS. 3A to 3C show a state in which the electrical insulator 1 is mounted on the stem base 3, wherein FIG. 3A is a front view, FIG. 3B is a sectional view taken on line X-O-X of FIG. 3A, and FIG. 3C is a sectional view taken on line X-O-Y of FIG. 3A.

Referring to FIGS. 3A to 3C, the electrical insulator 1 is mounted on the stem base 3 such that the bottom surface of the fixed portion 11 is brought into close-contact with the inner side of the stem base 3 and the projecting portion 12 is stuck on the inner surface side of the tip-containing portion 31 of the stem base 3 in a state being caught in the tip-containing portion 31. In this case, the pin-containing portions 13 of the fixed portion 11 are arranged in such a manner as to contain pin holes 32 in which the stem pins 4 to be insulated are to be inserted.

The stem base 3, to which the electrical insulator 1 is thus mounted, is mounted to the stem 2 of the cathode-ray tube such that the stem pins 4 of the stem 2 are inserted in the associated pin holes 32. At this time, the electrical insulator 1 is brought substantially into line-contact with the stem 2. Accordingly, air is not entrapped between the electrical insulator 1 and the stem 2 by gradually increasing a pressing force applied to the stem base 3 up to 1 MPa upon mounting of the stem base 3 to the stem 2. Then, the entire cathode-ray tube is heated in a heating furnace at 100° C. for 10 min, to ensure an adhesive strength, for example, 3.0 MPa, of the electrical insulator 1 to the stem base 3. In this way, a finished product of the cathode-ray tube on which the electrical insulator 1 is mounted can be obtained.

The cathode-ray tube thus obtained by the method described above was subjected to a dielectric strength test by applying 35 kV between those of the stem pins 4 to be insulated. As a result, any current leakage between the stem pins 4, that is, any failure of dielectric strength was not found.

In addition, the electrical insulator 1 in this embodiment is applied to a cathode-ray tube of a type in which a plurality of stem pins 4 to be insulated are mounted.

Figure 4A:
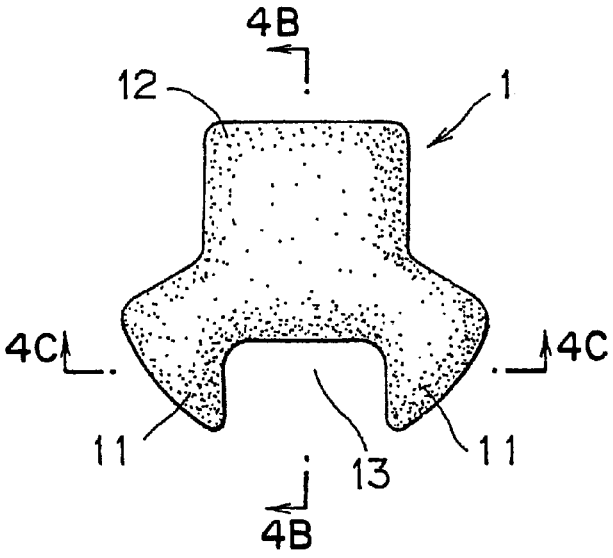
Figure 4B:
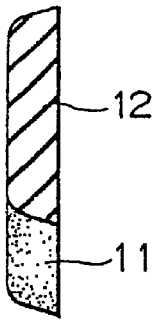
Figure 4C:
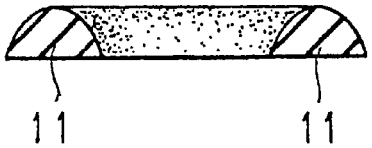

A second embodiment of the electrical insulator of the present invention will be described below. The electrical insulator in this embodiment is suitable for a cathode-ray tube of a type in which a potential difference between the stem pins 4 to which high voltages are applied is as low as about 100 V, and it is not required to insulate the stem pins 4 from each other. FIGS. 4A to 4C show the second embodiment of the electrical insulator 1, and FIGS. 5A and 5B show a state in which the electrical insulator 1 is previously mounted on the stem base 3.

FIG. 4A is a plan view of the electrical insulator, FIG. 4B is a sectional view taken on line X—X of FIG. 4A, and FIG. 4C is a sectional view taken on line Y—Y of FIG. 4A.

The electrical insulator 1 in the second embodiment includes a pin-containing portion 13 for collectively containing those of the stem pins 4, with potential differences therebetween being low enough not to be required to be insulated. To be more specific, the pin-containing portion 13 has a size capable of containing a plurality of the stem pins 4 not required to be insulated, and as needed, it is shaped such that a gap on the outer edge side is larger than that on the innermost side like the first embodiment. Further, like the first embodiment, the upper surface of the fixed portion is formed into, for example, an arcuate shape or an approximately triangular shape (not shown) in cross-section for allowing the upper surface of the fixed portion to be brought substantially into line-contact with the surface of the stem 2 when the stem base 3 is mounted on the stem 2 so as to prevent entrapment of air therebetween.

Figure 5A:
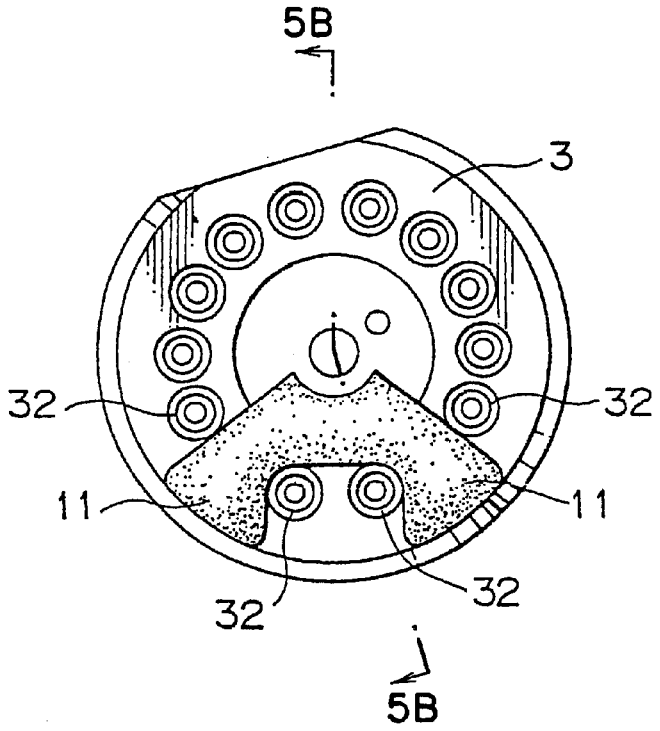
Figure 5B:
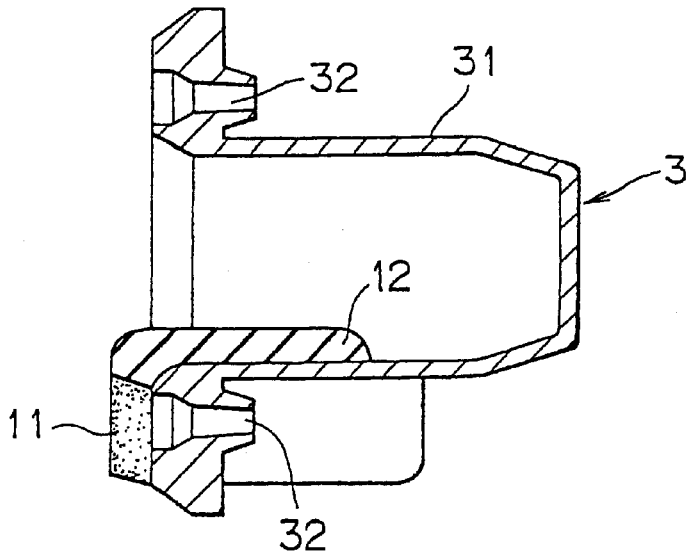

FIGS. 5A and 5B are structural views showing a state in which the electrical insulator 1 is mounted on the stem base 3, wherein FIG. 5A is a plan view and FIG. 5B is a sectional view taken on line X-O-Z.

In this embodiment, like the first embodiment shown in FIGS. 3A to 3C, the electrical insulator 1 is mounted to the stem base 3 such that the pin-containing portion 13 is aligned with the associated pin holes 32; the fixed portion 11 is fixed between the stem 2 and the stem base 3; and the projecting portion 12 is caught in the tip-containing portion 31.

The stem base 3 to which the electrical insulator 1 is previously mounted can be mounted to the cathode-ray tube in the same manner as described above. That is to say, the stem pins 4 of the stem 2 of the cathode-ray tube are inserted in the associated pin holes 32 and the stem base 3 is mounted to the stem 2 by gradually increasing a pressing force applied to the stem base 3, whereby the stem base 3 can be mounted to the cathode-ray tube without entrapment of air between the electrical insulator 1 and the stem 2.

While the preferred embodiments of the present invention have been described using the specific terms, such description is for illustrative purposes only, and it is to be understood that changes and variations may be made without departing from the spirit or scope of the following claims.

What is claimed is:

1. An electrical insulator, provided between a stem of a cathode-ray tube and a stem base mounted to said stem, for insulating stem pins erected on said stem from each other, said electrical insulator comprising:

a fixed portion held between said stem and said stem base; and a projecting portion caught in a tip-containing portion of said stem base, said projecting portion being formed integrally with said fixed portion;

wherein said fixed portion is provided with pin-containing portions containing said stem pins insulated by notches in said fixed portion on the outer edge side.

2. An electrical insulator according to claim 1, wherein an upper surface of said fixed portion is formed into such a shape as to be brought substantially into line-contact with said stem when said stem base adhered to said electrical insulator is mounted to said stem.

3. An electrical insulator according to claim 1, wherein each of said pin-containing portions opens outwardly, is formed in said fixed portion, and is shaped such that a gap on the outer edge side is larger than that on the innermost side.

4. A cathode-ray tube comprising:

an electrical insulator mounted between a stem and a stem base of an electron gun, said electrical insulator including a fixed portion and a projecting portion formed integrally with said fixed portion;

wherein said fixed portion is held between said stem and said stem base in such a manner that stem pins erected on said stem are contained in pin-containing portions formed in said fixed portion; and said projecting portion is caught between a tip of said stem and a tip-containing portion of said stem base.

5. The electrical insulator as set forth in claim 1 wherein said fixed portion includes a stem base side, shaped as a flat plane for close-contact with the stem base.

6. The electrical insulator as set forth in claim 5 wherein said fixed portion includes a stem side, opposite said stem base side, formed into an arcuate shape in cross-section brought substantially into line contact with a surface of the stem.

7. The electrical insulator as set forth in claim 1, wherein said fixed portion and said projecting portion have substantially planar sides in cross-section prior to assembly in said cathode ray tube.

8. An electrical insulator, for use as a component in a structure between a stem of a cathode-ray tube and a stem base mounted to said stem, for insulating stem pins erected on said stem from each other, said electrical insulator comprising:

a fixed portion structurally adapted to be held between said stem and said stem base; and a projecting portion structurally adapted to be caught in a tip-containing portion of said stem base, said projecting portion being formed integrally with said fixed portion;

wherein said fixed portion is provided with pin-containing portions structurally adapted for containing, when assembled, said stem pins to be insulated by forming notches in said fixed portion on the outer edge side.

9. An electrical insulator according to claim 8, wherein an upper surface of said fixed portion is formed into such a shape as to be brought substantially into line-contact with said stem when said stem base, adhered to said electrical insulator as a subassembly, is mounted to said stem.

10. An electrical insulator according to claim 8, wherein each of said pin-containing portions opens outwardly, is formed in said fixed portion, and is shaped such that a gap on the outer edge side is larger than that on the innermost side.

11. The electrical insulator as set forth in claim 8 wherein said fixed portion includes a stem base side is shaped as a flat plane for close-contact when assembled with the stem base.

12. The electrical insulator as set forth in claim 8 wherein said fixed portion includes a stem side, opposite said stem base side, formed into an arcuate shape in cross-section to be brought substantially into line contact with a surface of the stem, when assembled.

13. The electrical insulator as set forth in claim 1, wherein said fixed portion and said projecting portion have substantially planar sides in cross-section prior to assembly in a cathode ray tube.

* * * * *